United States Patent [19]

Diaz

[11] Patent Number: 4,871,178

[45] Date of Patent: Oct. 3, 1989

[54] BODY-SUPPORTED HOOP GAME AND DEVICE

[76] Inventor: Wilfredo S. Diaz, Urb. Carioca, Third Street, #1, Guayama, P.R. 00654

[21] Appl. No.: 276,690

[22] Filed: Nov. 28, 1988

[51] Int. Cl.[4] ..... A63B 67/00

[52] U.S. Cl. ..... 273/411; 273/359; 273/400; 273/412; 273/DIG. 19

[58] Field of Search ..... 273/411, 412, 414, 359, 273/398, 400, 1.5 R, 1.5 A, DIG. 17, DIG. 18, DIG. 19

[56] References Cited

U.S. PATENT DOCUMENTS

| | | | |
|---|---|---|---|
| D. 239,648 | 4/1976 | Somsky | 273/DIG. 19 X |
| 1,208,235 | 12/1916 | Thayer | 273/400 |
| 2,247,852 | 7/1941 | Saunders | 273/412 |
| 3,341,201 | 9/1967 | Ryan | 273/411 X |
| 3,610,622 | 10/1971 | Haroski | 273/414 X |
| 3,774,910 | 11/1973 | Walker, Jr. | 273/414 X |
| 4,017,076 | 4/1977 | Bai | 273/412 X |
| 4,274,639 | 6/1981 | Flanders | 273/414 X |
| 4,497,492 | 2/1985 | Lehman, Jr. et al. | 273/411 |
| 4,718,676 | 1/1988 | Collins, Jr. | 273/412 X |
| 4,718,677 | 1/1988 | Barnes | 273/412 |

*Primary Examiner*—William H. Grieb

*Attorney, Agent, or Firm*—Lynn E. Barber

[57] ABSTRACT

The invention comprises a body-supported hoop device and a team game utilizing the hoop device. The hoop device comprises a hoop, a net connected to the hoop and means for attaching the hoop to the legs of a goalie. In the game of the invention, the body-supported hoop devices are worn by each of two goalies. The object of the game is for team members of the goalie to place a projectile, such as a soccer ball, through the hoop of the goalie on their team and to prevent members of the opposing team from placing the projectile through the hoop of the goalie of the opposing team.

11 Claims, 5 Drawing Sheets

BODY-SUPPORTED HOOP GAME AND DEVICE

BACKGROUND OF THE INVENTION

1. Field of the Invention

This invention relates to a game and more particularly to a game in which a hoop and net are attached to and supported by the body of a receiver and positioned by the receiver to receive a ball projected by teammates of the receiver.

2. Description of the Related Art

In a variety of team sports, there are two goalies or receivers from opposing teams, each of which goalies is positioned at the opposite ends of the playing area from the other goalie. In these team sports, team members of each team attempt to move a projectile into a goal area near or behind the opposite team's goalie, who attempts to keep the projectile from moving into the goal area. Each goal area in these games comprises a net or circumscribed area behind and/or around the goalie, and the goalie must work to guard the entire goal area. In none of these games is the particular goalie a member of the same team that is attempting to place the projectile into that goalie's goal.

Examples of such team games include soccer, water polo and ice hockey. In soccer, the players of each eleven-membered team work to propel a round soccer ball into the opponent's goal area by kicking or hitting the ball with any part of their body except their hands or arms. The soccer goalie may use his hands to keep the ball out of the goal area. Similarly, in water polo, teams of swimmers work to place a ball into the goal area. In ice hockey, team members use angled hockey sticks to drive a puck, a disk of vulcanized rubber, into the opponent's goal.

Other games have been designed in which hoops or other projectile-receiving structures are attached to or held by players of the game. The receiving structures are mounted on waists, hips, ankles, arms or heads in the various games. Most of these games are played by one or two persons each of whom has such a receiving structure attached to the appropriate body part. The exercise and game apparatus of Flanders (U.S. Pat. No. 4,274,639) comprises a large ball rotatably mounted on shafts within a hoop. The hoop is secured by bars to the belts of each of the two players standing on opposite sides of the hoop. Baskets on the bars serve as goals for the ball thrown by the opposite player while both players use hip movements to keep the large ball rotating within the hoop.

Other hoop or basket games include those with tethered balls. The toy of Walker, Jr. (U.S. Pat. No. 3,774,910) has a waste-mounted target with a plurality of holes that is worn by one player. The second player wears a waist-tethered ball that must be manipulated by movement of the second player's waist to go through one of the holes on the target worn by the other player. There is also a single-person hip-mounted game that has a horizontally oriented basket on rigid shafts extending out from the hip. A ball is tethered to the shaft so that appropriate bodily motion causes the ball to go into the basket (U.S. Pat. No. 3,610,622). The design patent of Somsky (U.S. Pat. No. Des. 239,648) has funnel-shaped receptacles mounted on each side of the waist, and a tethered ball at each receptacle.

A variety of devices enables catch to be played, for example, by using a netted or basket structure to catch the projectile. An ankle-mounted ball-catching net allows arm-impaired persons to play catch (U.S. Pat. No. 4,718,676). Another catch game utilizes Velcro TM covered projectiles and knee-mounted Velcro TM-adherent receivers (U.S. Pat. No. 4,718,677). Another game of catch employs Velcro TM strips on a plastic ball and utilizes fabric covered dish-shaped mitts to catch the ball (U.S. Pat. No. 4,017,076).

Other devices may be mounted on the body or held by the player for protection in ball games or to enable the player to make the ball rebound in a particular manner. See for example, the head-mounted rebounding device of Ryan (U.S. Pat. No. 3,341,201), and the hand-held shield of Lehman, Jr., et al. (U.S. Pat. No. 4,497,492). Many other net and racquet games and devices also exist that do not have the projectile receiving structure attached to a player.

It is therefore an object of this invention to provide a body-supported hoop that may be used in a team game.

It is a further object of this invention to provide a body-supported hoop that is attached to the legs of a goalie.

It is a further object of this invention to provide a ball game in which each of two teams tries to impel the ball through a hoop and net attached to that team's goalie.

It is a further object of this invention to provide a ball game wherein the ball-receiving area is mounted on the goalie and in which the goalie may move the ball-receiving area by movement of the goalie's body.

Other objects and advantages will be more fully apparent from the following disclosure and appended claims.

SUMMARY OF THE INVENTION

The invention comprises a body-supported hoop device and a team game utilizing said body-supported hoop device. The body supported hoop device comprises:

(a) a hoop made up of a plurality of pivotally attached curvilinear sections; and (b) means for attaching the hoop to the legs of a person.

Preferably a net similar to but larger than a basketball net is connected to the hoop.

In one preferred embodiment, the hoop comprises two stainless steel sections, each of which is preferably covered by solid rubber or another firm, resilient and protective, cushioning substance. A first end of the first section is movably attached to a first end of the second section and the second end of the first section is attached to the second end of the second section to form a circular hoop. A standard basketball net, preferably closed at the bottom to contain the ball, is attached to the hoop.

The net is preferably connected to the hoop by means of hooks similar to those used to attach a basketball net to a basketball hoop. Additional attachment means, perferably a pair of loops on each section enable attachment of the hoop to each of a pair of leg-surrounding girdles and, together with the girdles, preferably comprise the means of attaching the hoop to the legs of the goalie or receiver. The girdles can be elastic, such as elastic knee pads used in volleyball or basketball. Alternatively, the leg girdles are similar to chaps of leather, and/or rubber, or other sturdy material and are laced tightly around the leg and/or buttoned or otherwise fastened to the pants of the receiver. Knee pads may also be worn and formed as part of the girdle structure or may be worn as separate knee pads. The girdle structure can thus be adapted to fit on the upper legs or on the knee area of the legs.

In the preferred method of use of the body-supported hoop device of the invention, the goalie (also called the receiver or catcher) of each team wears the body-supported hoop device attached to his legs. Each goalie is located within that team's prescribed goal area at the opposite end of the playing area from the other goalie. As governed by rules of the game, teams work to obtain possession of a ball and attempt to propel the ball into the hoop and net worn by their own goalie. The team not in possession of the ball attempts to obtain possession of the ball so that play can proceed toward its own goalie. The preferred ball in the game of the invention is a soccer ball.

Other aspects and features of the invention will be more fully apparent from the following disclosure and appended claims.

DETAILED DESCRIPTION OF THE INVENTION, AND PREFERRED EMBODIMENTS THEREOF

The present invention comprises a body-supported hoop and net device 20 (basket) for use by a goalie in playing a field game according to the invention. The hoop and net device includes a hoop 22 attached to a net 24 and to leg girdles 26 worn by the goalie.

Figure 4:
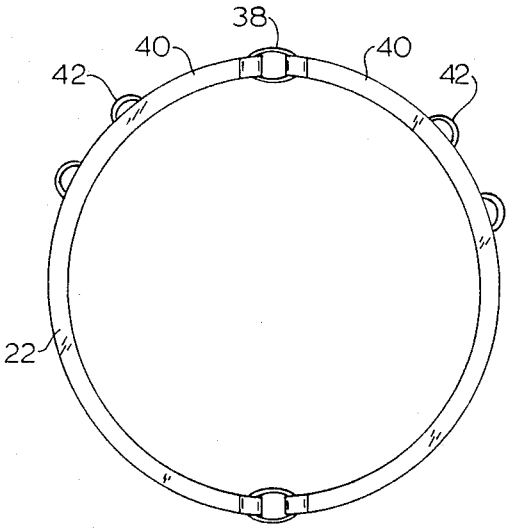
FIG. 4 is a plan view of a hoop according to the invention formed with the sections of FIG. 3 and 3A after being curved and connected together but prior to installing the net.
Figure 5:
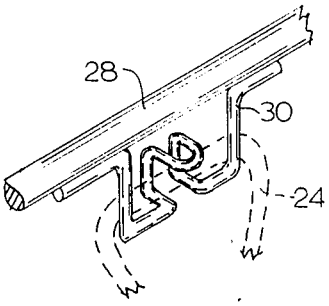
FIG. 5 is a perspective partial view of a hoop section showing a hook and attachment of the net to the hook.

Each hoop 22 is preferably comprised of two curved sections that are attached to each other. Each section 28 is made from a straight piece of bendable material (shown as a straight piece in FIGS. 1–3A) such as steel or heavy rubber or plastic. The sections 28 may be round, rectangular or multiply-angled in cross section. Each section 28 has a plurality of hooks 30 preferably similar to those used on basketball hoops protruding from the section 28 for attachment of a net 24 (FIG. 5). If the bendable material is steel, it preferably has a diameter of about ⅛" and is covered with a coating 32 of rubber or resilient plastic or plastic-like material to cushion any impact of a player with the hoop 22 (FIGS. 3 and 3A). At each end of each section 28 is a firmly attached end-piece 34 with a hole 36 through it so that each end 34 may be linked to an end 34 of a second section 28 (FIG. 4). The end-piece 34 is shown in FIG. 3 as a rounded piece having an interior hole 36 but may also be constructed in other forms providing a movable connection means between the end pieces. Any suitable means for linking the ends 34 of the two sections 28 may be used and is illustrated as a conventional latch 44 as used on dog chains and the like. The two sections 28 may be molded as an integral piece and formed with flexible joints particularly if the bendable material is rubber or plastic.

Figure 6:
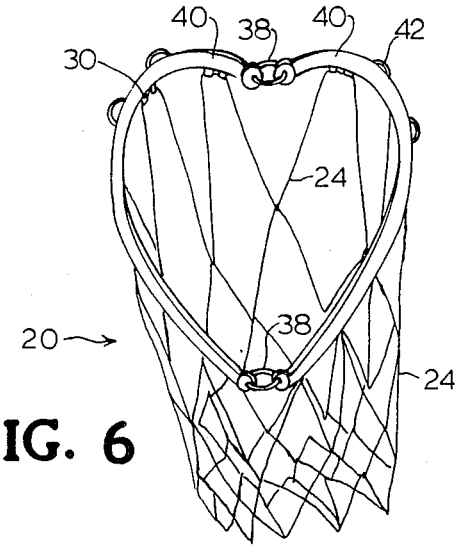
FIG. 6 is a perspective view of the hoop of FIG. 4 in a partially folded position and with the net installed.
Figure 7:
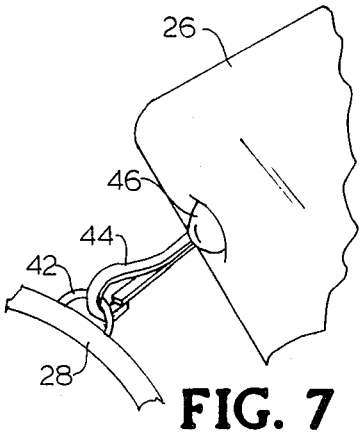
FIG. 7 is a partial perspective view of a spring latch for holding the hoop to a leg girdle.

As shown in FIG. 6, use of two flexible joints opposite each other on the hoop 22 enables the halves 40 of the hoop 22 to be moved into a variety of "V" shapes (when the hoop is viewed from the side) depending on how closely the sides of the hoop 22 between the links 38 are moved toward each other. Thus, when the hoop 22 is attached to a player, he or she may move more easily due to the relative movability of the halves 40 of the hoop 22.

The net attached to the hooks 30 on the hoop section is preferably the same style as is used in basketball, except that the net is perferably larger than a basketball net to better avoid the net becoming tangled on the lower part of the hoop during play such as when the receiver jumps to catch the ball. The bottom portions 48 of the net 24 may be sewn together to keep a ball caught in the net from bouncing away from the goalie. Other durable net materials such as certain flexible plastics may also be used.

Figure 1:
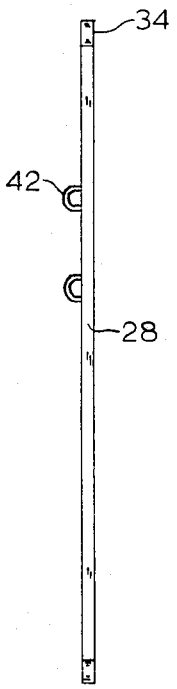
FIG. 1 is an elevational view of one section of a hoop according to the invention before the section is curved to form the hoop and before the section is coated.
Figure 2:
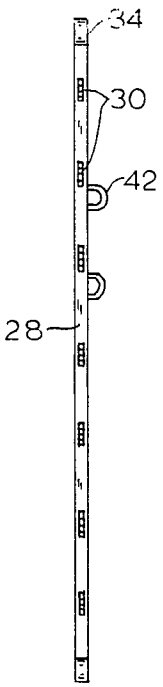
FIG. 2 is an elevational view of the hoop section of FIG. 1 viewed from the opposite side.
Figure 3:
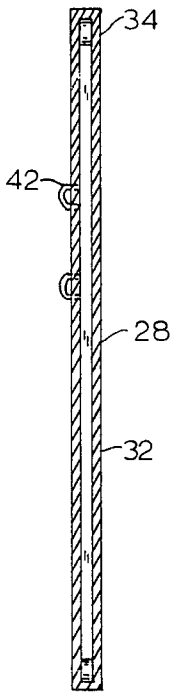
FIG. 3 is a side sectional elevational view of a section of the hoop of the invention prior to being curved and after being covered with rubber.
Figure 3A:
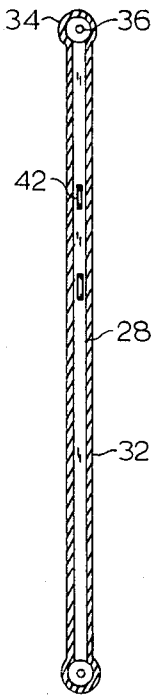
FIG. 3A is a sectional view of the section of FIG. 3 after a 90-degree rotation of the section.

Two or more loops 42 formed integral with section 28 are positioned toward one end of each hoop section 28 for attachment of the hoop 22 to leg girdles 26 worn by the player (FIGS. 1–3). Latch fasteners are used to attach the loops 42 on the hoop 22 to girdle loops 46, the girdle loops 46 being attached either directly or by means of tabs or other known fastening means to the leg girdles 26 of the invention.

Figure 8:
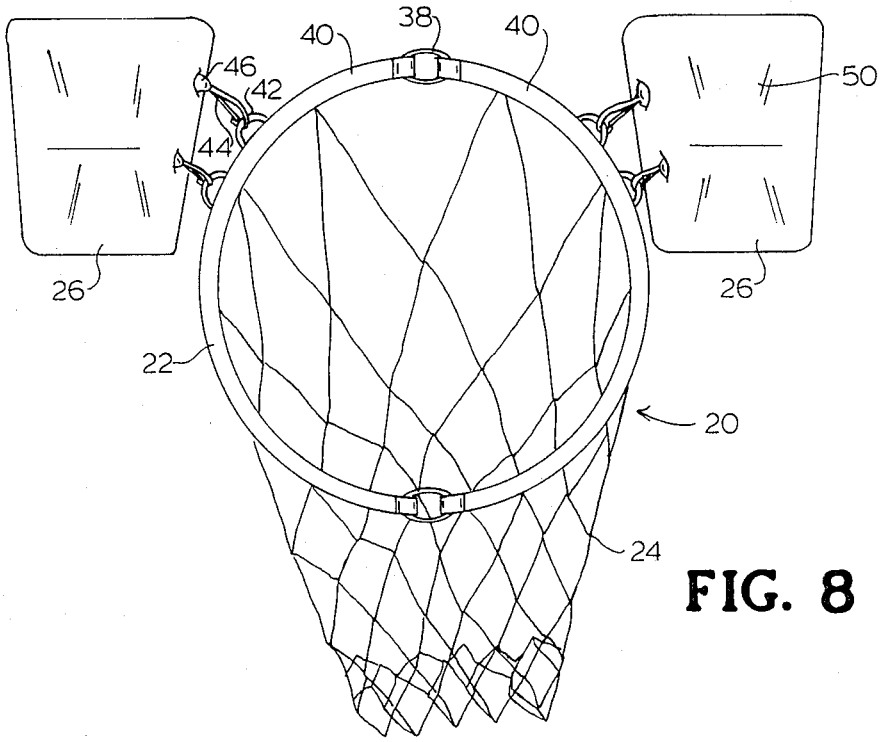
FIG. 8 is a perspective frontal view of a hoop, a net and elastic leg girdles in a first embodiment of the invention.
Figure 9:
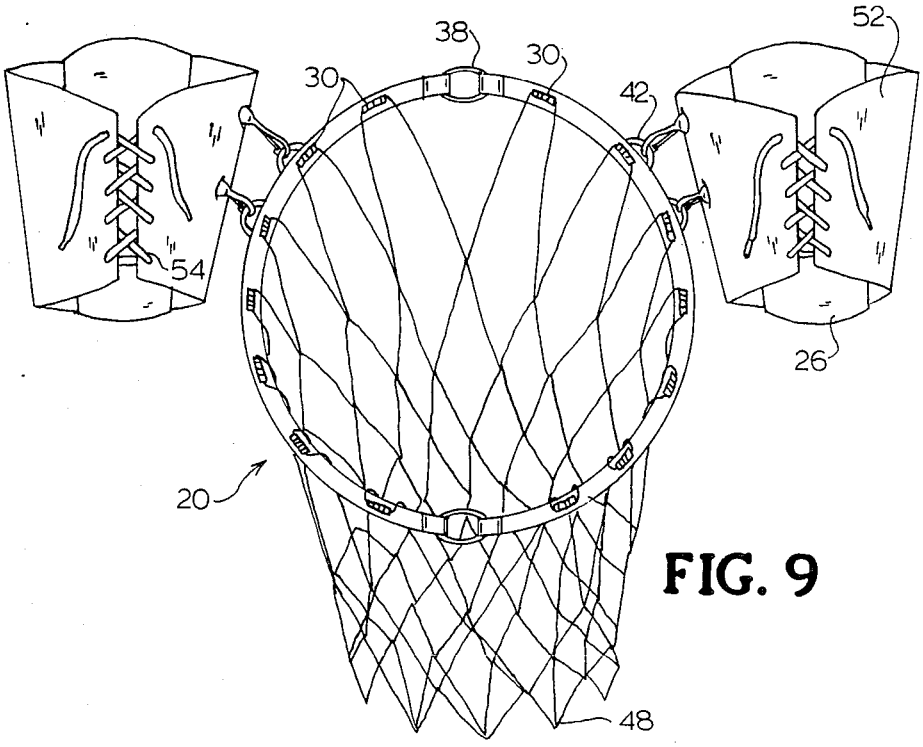
FIG. 9 is perspective back view of a hoop, a net and laced leg girdles in a second embodiment of the invention.

Leg girdles 26 for encircling each leg are provided for attachment of the hoop 22 to the wearer's legs. The leg girdles 26 are preferably made of an elastic material, such as illustrated in the elastic knee pads 50 similar to those worn in basketball or volleyball (FIG. 8). Alternatively, the leg girdles 26 may be pieces 52 of leather, rubber or other flexible, tear-resistant, sturdy material or a combination of such materials that are positioned tightly around the wearer's legs such as by means of laces 54 (FIG. 9), small buckled straps or overlapping adhesive portions, such as by using Velcro TM (not shown). To keep the leg girdle 26, particularly the non-elastic embodiment, from sliding down the leg, buttons or other fasteners (not shown) such as those used for attaching parts of clothing together may be used to attach the leg girdle 26 to the wearer's pants, for example.

Figure 10:
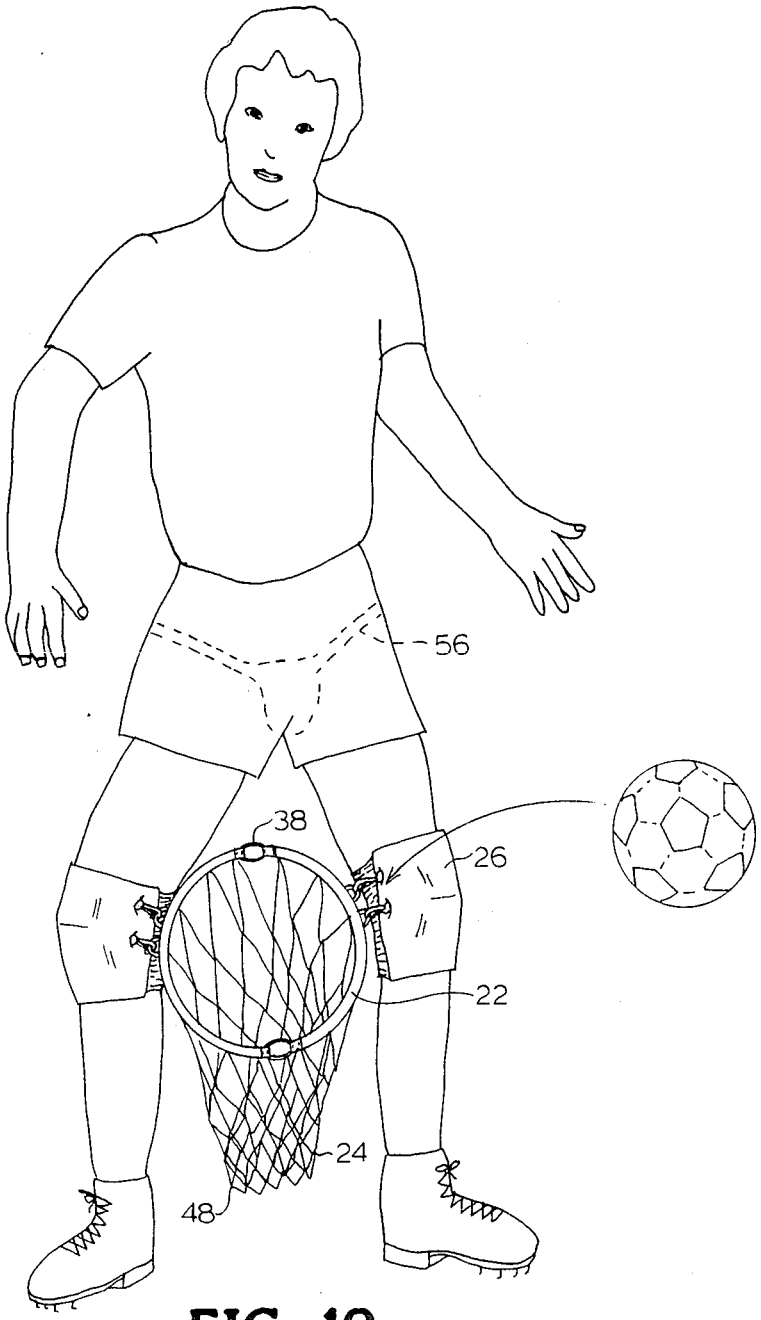
FIG. 10 is a perspective view of the device of the invention as worn by a goalie.

When the body-supported hoop device 20 is utilized in a team game according to the invention, a conventional crotch guard 56 (FIG. 10) is preferably employed to shield the wearer's groin area from impact with the ball. Other guards for the chest and face may also be worn. Although the body-supported hoop is attached to the wearer's legs in the preferred embodiment of the invention, the hoop may alternatively be attached to the wearer's arms in a variant of the game of the invention if appropriate modifications of the attachment means and girdles are made and appropriate protective measures are taken for the head.

Figure 11:
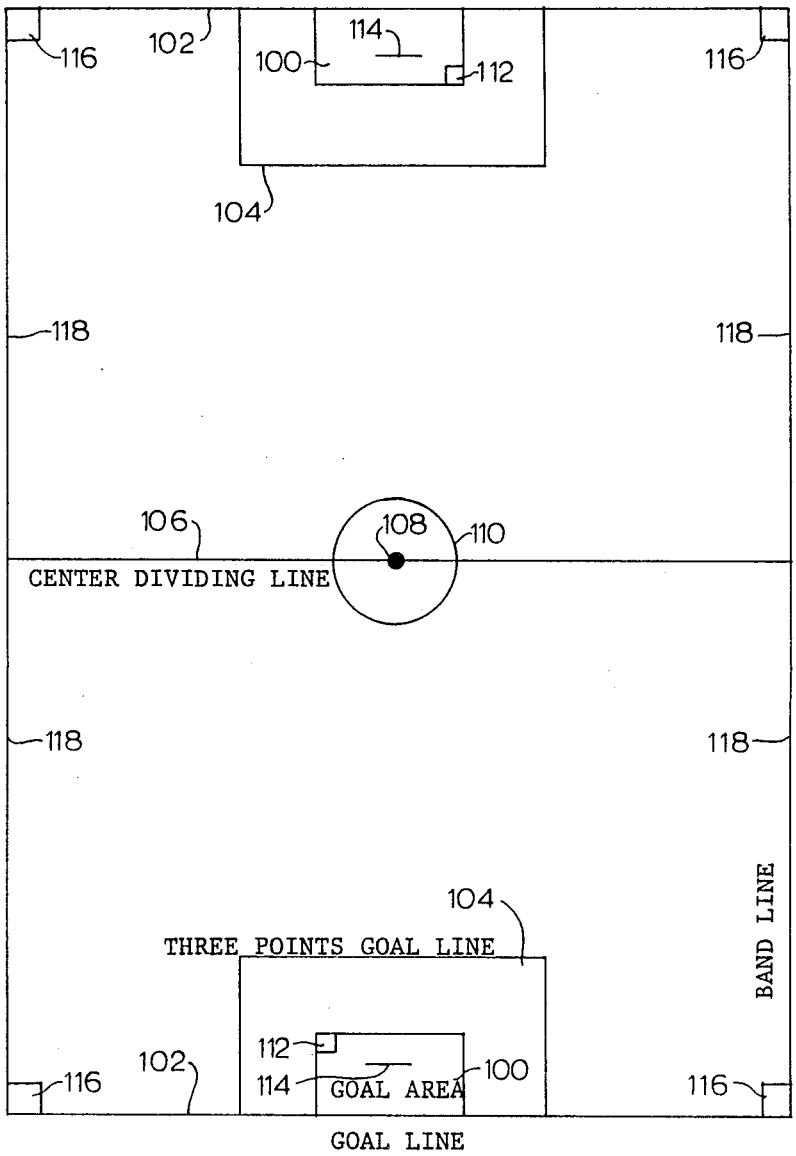
FIG. 11 is a schematic diagram of a playing field upon which the device of the invention may be used by goalies to play the game of the invention.

The team game of the invention utilizing the body-supported hoop device 20 preferably is either played on a regular soccer field (120 feet by 75 feet) or on a larger field (200 feet by 165 feet) as illustrated diagrammatically in FIG. 11. The game of the invention may also be played indoors on a wood floor court such as a basketball court. In this case, the hoop preferably is smaller and the ball is of a size similar to a volleyball and is similarly adapted and cushioned for indoor use. Areas and lines discussed below are marked on the field or court by means known in the art. The dimensions given are for the larger field. Appropriate adjustment of the outer dimensions are made for fields of other sizes with the preferred dimensions of the goal areas, goal point areas, and circle being the same on the different sizes of playing area. The two goal areas 100 are rectangles, preferably 25 feet by 20 feet and positioned centrally along the goal lines 102 on each end of the field. A larger goal points area 104 extends 20 feet out from each of the three sides of the goal area 100 within the playing field. The line around the goal points area 104 is the "three points goal line." A center dividing line 106 divides the field equally and has a center point 108 marked at its center and a 15 foot diameter circle 110 marked about the center point 108. Within each goal area 100, is a left front corner 112 and a free shot line 114, the free shot line being four feet long and 15 feet from and parallel to the goal line.

A team of 9–11 players (depending on field size) is positioned as in soccer or as two wingers (left and right), two insiders (left and right), one center forward, three backs (left, middle, right) and a catcher (goalie).

Rules for playing the game may vary in accordance with age and dexterity of players and with local preference. The rules outlined below provide a competitive, interesting game. It is appreciated that a wide variety of rules and scoring schemes may be utilized within the scope of the invention.

The preferred rules with some possible variations are discussed below. The first offensive team is determined by flipping a coin or by other random means. The ball is placed by a referee on the center point 108, who then whistles to order the starting kick. Only after the ball has been touched by players other than the kicker may the player who kicked the ball initially touch the ball; otherwise, the opposing team will be given the ball to be put into play from the band line 118 closest to where the play occurred. This play must be done within six seconds, the player throwing the ball with both hands from the top of the head, without stepping across the boundaries of the band line. The ball is given to the second team for the same play if the first team does not abide by the play restrictions.

The following acts result in the ball being put into play by the opposition from the left front corner 112 of the side on which the act occurred: stepping over any of the lines around the goal area 100 by the receiver, stepping inside the goal area by an offensive player, stepping across the free shot line 114 by the kicker or stepping across the goal line 102 by the receiver during a free kicks play (see below), after free kicks are performed, and when the ball is "dead" because the receiver fails to catch it and it remains in the goal area 100 once it has made contact with the receiver or the net/-hoop.

If a defensive player steps inside the goal area 100 or on its lines, the opposite team captain designates a player to perform two free kicks from the free shot line 114. This player tries to place the ball in the air and into the basket of the catcher behind the goal line 102. The catcher is permitted to move either backwards or to either side but not across the goal line 102. No other players are allowed to intervene in the free kicks play, which count one point each.

Free kicks are also performed (two each time) when a player commits faults (technical or physical). Physical faults include physical contact with opposite players (grabbing, hitting, pushing, kicking, charging against, jumping over). If the receiver interferes with a player of the opposing team who is putting the ball back into play from the left front corner 112, that player may make two free kicks from the free shot line 114 on his teams' side of the field (or court).

Points may also be made by: (a) kicking of the ball by a player from outside the three points goal line into the basket without the ball touching the ground, (three points); (b) same as (a) but the ball hits the ground one or more times (two points); (c) kicking a ball from the area between the three points goal line and the goal area into the basket but without hitting the ground (two points); and (d) same as (c) but the ball hits the ground (one point).

When a ball is kicked and a defensive player in the area between the goal area and the three points goal line uses his head to deflect the airborne ball, the play is declared "goal tending" and the offensive team receives three or two points respectively depending on whether the shot was performed from outside the three points goal line or from within the area between the three points goal line and the goal area.

If a defensive player touches the ball with his hands or arms in the defensive area (on the side of the opposite team's goalie), the referee orders a free shot, make by a player chosen by the offensive team's captain, from the point where the play occurred. If the ball does not touch the ground, two or three points are scored, depending if the kick is from outside or inside the three points goal line. If the defensive player touches the ball with hands or arms in the area between the goal area and three points goal line and the ball goes out of the field, a free shot is ordered by the referee from the field corner 116 on the side where play occurred (a "corner" shot). Again the kicker is chosen by the offensive captain.

If an offensive player touches the ball with his hands or arms, the ball is given to the opposing team to put back into play from the left front corner 112 on the side of the field where the ball was touched.

Restarting of play under the specified circumstances occurs as follows: (a) after a goal, by a player of the opposite team in the same manner as the game was started; and (b) after a temporary suspension of play, by the referee from the band line 118 closest to where the last play occurred. The ball remains playable if it hits the receiver and bounces back into the playing field, or crosses the goal area without hitting the receiver and bounces out of the goal area to the playing field, or if it hits a referee or lines-judge and goes back into the field (if no violation is announced).

If the ball goes out of the field through the side of the field (band line 118), the ball is put back into play by any player from the point on the band line 118 where the ball went out.

If the ball enters the goal area 100 but is too high for the receiver to catch it in the basket, the receiver may catch the ball with his hands and return the ball to any of his teammates.

As in soccer, two serious faults ("yellow cards") or one extremely serious fault ("red card") signify automatic ejection or expulsion of a player from a game for the entire game. Ordinary (not serious) faults result in no expulsion. All faults result in two free kicks for the other side. Except for expelled players, other ordinary substitutions may be made as in basketball.

A game lasts sixty minutes (two 30 minute halves) with a twelve minute half-time rest period. The clock is stopped at unexpected incidents, free kicks, and after a goal is scored. If the score is tied at the end of a game, a ten minute overtime is played with teams changing sides at five minutes. If there is still a tie after the overtime, a tie is declared by the referee and there is no further play. The team changes sides of the field at half-time and play is resumed by an initial kick of a player of the opposite team from that that started the game. Only players, referees (two) and line-judges (two) are allowed on the field. The timekeeper and scorer are outside the field at the center dividing line. Protests are handled as in soccer with the referee's decision being final.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A game for two opposing teams, each team having a plurality of players and a goalie, comprising:

(a) a plurality of hoop devices, one for each goalie, said hoop device comprising a hoop made of a plurality of pivotally attached curvilinear sections, and means for attaching the hoop to the goalie; and (b) a projectile means of a size to fit through the hoop; whereby the object of the game is for the players of each team to cause the projectile means to enter the hoop attached to the goalie of the same team and to prevent the projectile from entering the hoop attached to the goalie of the opposing team, each of said pivotally attached curvilinear sections on each hoop device being positionally movable with respect to each of the other sections on the same hoop device while the hoop is attached to the goalie, said movement of said sections with respect to the movement of the other sections facilitating movement of the goalie.

2. A game according to claim 1, further comprising a net connected to the hoop.

3. A game according to claim 2, wherein the hoop comprises two sections, each of said sections has two opposite ends, the ends of each section being pivotally attached to the opposite ends of the other section.

4. A game according to claim 2, wherein the net has a top which is attached to the hoop and a bottom which is closed to retain the projectile.

5. A game according to claim 2, wherein said game is played on a defined field having two ends and a goal area at each end.

6. A game for two opposing teams, each team having a plurality of players and a goalie, comprising:

(a) a plurality of hoop devices, one for each goalie, said hoop device comprising a hoop made of a plurality of pivotally attached curvilinear sections, and means for attaching the hoop to the goalie, said means of attaching the hoop to the goalie comprising a plurality of loops on the hoop, two leg girdles and means for attachment of the leg girdles to the hoops;

(b) a projectile means of a size to fit through the hoop; and (c) a net connected to the hoop.

7. A hoop device for use in catching a projectile, said hoop device comprising:

(a) a hoop made of a plurality of pivotally attached curvilinear sections; and (b) means for attaching the hoop to a person, each of said pivotally attached curvilinear sections on each hoop device being positionally movable with respect to each of the other sections on the same hoop device while the hoop is attached to the person, said movement of said sections with respect to movement of the other sections facilitating movement of the person.

8. A hoop device according to claim 7, further comprising a net connected to the hoop.

9. A hoop device according to claim 8, wherein the hoop comprises two sections, each of said sections having two opposite ends, the ends of each section being movably attached to the opposite ends of the other section.

10. A hoop device according to claim 8, wherein the net has a top which is attached to the hoop and a bottom which is closed to retain a projectile.

11. A hoop device for use in catching a projectile, said hoop device comprising:

(a) a hoop made of a plurality of pivotally attached curvilinear sections;

(b) means for attaching the hoop to a person the means for attaching the hoop to the goalie comprising a plurality of loops on the hoop, two leg gridles and means for attachment of the leg girdles to the loops; and (c) a net connected to the hoop.

* * * * *

UNITED STATES PATENT AND TRADEMARK OFFICE

CERTIFICATE OF CORRECTION

PATENT NO. : 4,871,178

DATED : October 3, 1989

INVENTOR(S) : Wilfredo Santiago

It is certified that error appears in the above-identified patent and that said Letters Patent is hereby corrected as shown below:

At title page, change inventor from "Wilfredo S. Diaz" to read --Wilfredo Santiago--.

Column 2, line 59, change "perferably" to --preferably--.

Column 4, line 31, change "perferably" to --preferably--.

Signed and Sealed this

Eleventh Day of September, 1990

*Attest:*

HARRY F. MANBECK, JR.

*Attesting Officer*

*Commissioner of Patents and Trademarks*